US006584909B2

(12) United States Patent
Brede et al.

(10) Patent No.: US 6,584,909 B2
(45) Date of Patent: Jul. 1, 2003

(54) METHOD FOR THE MANUFACTURE OF A CARTRIDGE CONSISTING OF A CASE AND A PROJECTILE

(75) Inventors: Uwe Brede, Furth (DE); Jens-Peter Reimer, Herzogenaurach (DE); Peter Wagner, Furth (DE)

(73) Assignee: Dynamit Nobel GmbH Explosivstoff-und Systemtechnik, Troisdorf (DE)

( * ) Notice: Subject to any disclaimer, the term of this patent is extended or adjusted under 35 U.S.C. 154(b) by 0 days.

(21) Appl. No.: 10/096,847

(22) Filed: Mar. 14, 2002

(65) Prior Publication Data

US 2002/0088366 A1 Jul. 11, 2002

Related U.S. Application Data

(63) Continuation of application No. 09/424,743, filed as application No. PCT/EP98/03151 on May 28, 1998, now Pat. No. 6,367,386.

(30) Foreign Application Priority Data

May 28, 1997 (DE) ..... 197 22 564

(51) Int. Cl.[7] ..... F42B 5/18; F42B 3/00

(52) U.S. Cl. ..... 102/431; 102/430

(58) Field of Search ..... 102/430, 431; 29/1.3; 86/25, 43

(56) References Cited

U.S. PATENT DOCUMENTS

| | | | |
|---|---|---|---|
| 4,593,621 | A | 6/1986 | Buchner |
| 5,256,203 | A | 10/1993 | Moore |

FOREIGN PATENT DOCUMENTS

| | | |
|---|---|---|
| EP | 633448 | 11/1995 |
| GB | 2305994 | 4/1997 |

*Primary Examiner*—Michael J. Carone
*Assistant Examiner*—Aileen B. Felton
(74) *Attorney, Agent, or Firm*—Antonelli, Terry, Stout & Kraus, LLP

(57) ABSTRACT

The invention relates to a method for producing a cartridge consisting of a case and a projectile, characterized in that, once the cartridge is fully manufactured, a capillary active, acrylate-based adhesive sealing agent is applied in a controlled manner to the gap arising in the inner mouth of the case when the projectile is inserted therein, in a sufficient quantity as to guarantee full sealing of said gap.

9 Claims, No Drawings

METHOD FOR THE MANUFACTURE OF A CARTRIDGE CONSISTING OF A CASE AND A PROJECTILE

This is a continuation of application Ser. No. 09/424,743, filed Jan. 28, 2000 now U.S. Pat. No. 6,367,386, which is a 371 of PCT/EP98/03151 filed May 28, 1998.

The subject matter of the present invention is a method for the manufacture of a cartridge consisting of a case and a projectile, the cartridges which can be manufactured according to this method, as well as the use of an acrylate adhesive for the sealing of a cartridge consisting of a case and a projectile.

Cartridges which have a gap between the cartridge case and the projectile are usually sealed with a sealant. In the prior art the use of bitumen as sealant is known. For this purpose the cartridge cases are coated with a bitumen-based sealant at the so-called inner mouth of the case and are subsequently worked on, i.e. projectile and powder are introduced into the case.

Problems have arisen again and again with the use of bitumen-based sealants. These problems stem, among other things, from the fact that the working characteristics and material characteristics of the bitumen varnish used are very variable. This results in different degrees of dryness and different layer thicknesses during use. The different layer thicknesses lead to case expansions, with the result that the cartridge is not loadable. A further problem with working with bitumen varnish as sealant is the displacement of the bitumen varnish layer into the loading chamber. The case becomes slack as a result and the loading chamber is made smaller. Moreover, as a result of the solvent constituent, which is associated with the working, compatibility problems with the propellant powder can occur. Automation of the sealing procedure is not possible with the use of bitumen-based sealants.

The object of the present invention was therefore to remove these disadvantages of the prior art in the sealing of the cartridge cases. The object was achieved with the features of the main claim and the secondary claims. Primarily developments are in the subclaims.

The solution in accordance with the invention provides the use of an anaerobically hardening sealant which does not contain any solvent and which is capillary-active. A sealant from the group of acrylate adhesives is preferably used. Particularly preferred is a mixture of 2-hydroxypropyl methacrylate and lauryl methacrylate with the auxiliary materials and/or additives usual for acrylate adhesives. Such acrylate adhesives are known by the name Permabond®, for example. The acrylate-adhesive-based sealants to be used in accordance with the invention have a low viscosity, for example a viscosity of 7 $mm^2/s$ at 25° C., and a low surface tension, for example a surface tension of about 30 mN/m. As a result of this, the sealants in accordance with the invention can enter very narrow gaps by capillary action and therefore also can enter the gap between the cartridge case and the projectile, the so-called inner mouth of the case which is formed when working with cartridges.

Whereas with the use of bitumen varnish the sealant must be applied to the inner mouth of the case before working with out the cartridge, the method in accordance with the invention provides for the application of the sealants, to be used in accordance with the invention, to the cartridge, at any time working therewith is complete. The method in accordance with the invention provides for the application of the sealants, to be used in accordance with the invention, to the gap at the inner mouth of the case, which gap is produced when the projectile is placed in the case, in a controlled manner and in quantities which are sufficient for the complete sealing, with the sealants to be used in accordance with the invention entering the gap by capillary action. The sealants provided harden very quickly so that hardening periods no longer apply. Because the hardening periods no longer apply, an immediate further working is possible. The production times are drastically reduced, with the result that the method in accordance with the invention is excellently suited for use in various automatic loading and assembly machines. After the hardening, the sealant is resistant to thermal and chemical stress to a very great extent. As a result of the absence of solvent, no problems with the propellant powder are even to be expected; powder compatibility is therefore provided with the use of the sealants to be used in accordance with the invention.

To be able to measure out the sealant in a controlled manner, a detector is preferably used which makes possible the precise measuring out and therefore exactly the addition of the quantities of the sealant which are sufficient for the sealing. For the economical designing of the sealing procedure the invention provides preferably the addition of an indicator to the sealant to be used. This addition of an indicator makes it possible in a particular manner to automate the sealing of the inner mouth of the case. All means which are compatible with the sealants to be used in accordance with the invention and which can be easily detected are in themselves suitable as indicator. Fluorescent indicators are particularly preferred, UV fluorescent indicators being very particularly preferred, in particular those which are visible at a wavelength of 375 nm. The quantities to be used depend on the used indicator itself, with the quantities of the addition not being critical. Usually up to 30% by weight, preferably up to 15% by weight of an indicator can be added. 0.1% by weight, 0.2% by weight, 0.3% by weight or also any other value can be taken as the lower limit. The only condition is that the quantities of the indicator do not impair the hardening of the sealant, but, on the other hand, are sufficient to be detectable.

On the one hand, this indicator additive makes possible a simple and rapid recognition and examination of the sealant, for example as to whether the sealant has sealed the gap completely. Moreover, the addition of the indicator makes possible a particularly sparing use of the sealant because the measuring out of the sealant can be controlled. A so-called luminescent key which makes UV fluorescent indicators at a wavelength of 375 nm visible is named as detector, for example.

The sealants to be used in accordance with the invention can be used with all cartridge types which have a gap for receiving the sealant when the projectile is placed into the case.

With the method in accordance with the invention it is possible for the first time to seal a cartridge consisting of a case and a projectile, which has a gap at the inner mouth of the case, the cartridge being produced when the projectile is placed into the case, precisely with the quantity of sealant which is necessary and sufficient for the sealing. These cartridges are therefore also the subject matter of the present invention.

What is claimed:

1. Process for producing a cartridge comprising:

assembling a case and a projectile;

metering a capillary-active, anaerobically setting sealant into a gap which forms when the bullet is joined to the case on the inside mouth of the case in an amount which is sufficient for complete sealing of the gap, the sealant containing an indicator which can be detected by a detector; and controlling the metering of the sealant by the detector.

2. Process for producing a cartridge as claimed in claim 1, wherein the sealant comprises an acrylate adhesive.

3. Process for producing a cartridge as claimed in claim 1, wherein the indicator is a fluorescence indicator.

4. Process for producing a cartridge as claimed in claim 1, wherein the indicator is an UV fluorescence indicator.

5. Process for producing a cartridge as claimed in claim 4, wherein the UV fluorescence indicator is visible at a wavelength of 375 nm.

6. Process for producing a cartridge as claimed in claim 1, wherein the sealant contains up to 30% by weight of the indicator.

7. Process for producing a cartridge as claimed in claim 1, wherein a luminescence probe is used as a detector.

8. Process for producing a cartridge as claimed in claim 1, wherein the sealant contains up to 15% by weight of the indicator.

9. Cartridge produced by the process or claims in claim 1.

* * * * *